US006885345B2

(12) United States Patent
Jackson

(10) Patent No.: US 6,885,345 B2
(45) Date of Patent: Apr. 26, 2005

(54) ACTIVELY RECONFIGURABLE PIXELIZED ANTENNA SYSTEMS

(75) Inventor: Thomas N. Jackson, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 1 day.

(21) Appl. No.: 10/712,666

(22) Filed: Nov. 13, 2003

(65) Prior Publication Data

US 2004/0095288 A1 May 20, 2004

Related U.S. Application Data

(60) Provisional application No. 60/426,993, filed on Nov. 14, 2002.

(51) Int. Cl.[7] ..... H01Q 1/38

(52) U.S. Cl. ..... 343/700 MS; 343/876; 343/853

(58) Field of Search ..... 343/700 MS, 753, 343/754, 755, 756, 853, 876, 745

(56) References Cited

U.S. PATENT DOCUMENTS

| | | | | |
|---|---|---|---|---|
| 5,293,172 A | | 3/1994 | Lamberty et al. | 343/701 |
| 5,472,935 A | | 12/1995 | Yandrofski et al. | 505/210 |
| 5,519,565 A | | 5/1996 | Kalt et al. | 361/280 |
| 5,557,286 A | | 9/1996 | Varaden et al. | 343/700 MS |
| 5,589,845 A | | 12/1996 | Yandrofski | 343/909 |
| 5,617,103 A | | 4/1997 | Koscica et al. | 343/700 MS |
| 5,657,024 A | | 8/1997 | Shingyoji et al. | 342/175 |
| 5,721,194 A | | 2/1998 | Yandrofski et al. | 505/210 |
| 5,864,322 A | * | 1/1999 | Pollon et al. | 343/909 |
| 5,990,766 A | | 11/1999 | Zhang et al. | 333/205 |
| 6,061,025 A | | 5/2000 | Jackson et al. | 343/700 |
| 6,096,127 A | | 8/2000 | Dimos et al. | 117/9 |
| 6,198,438 B1 | | 3/2001 | Herd et al. | 343/700 |
| 6,211,096 B1 | | 4/2001 | Allman et al. | 438/787 |
| 6,292,143 B1 | | 9/2001 | Romanofsky | 343/700 |
| 6,307,519 B1 | | 10/2001 | Livingston et al. | 343/767 |
| 6,469,677 B1 | | 10/2002 | Schaffner et al. | 343/876 |
| 6,473,037 B2 | | 10/2002 | Vail et al. | 342/372 |
| 6,496,147 B1 | | 12/2002 | Kirino | 343/700 |
| 6,498,369 B1 | | 12/2002 | Yamazaki et al. | 257/347 |
| 6,567,046 B2 | * | 5/2003 | Taylor et al. | 343/700 MS |

* cited by examiner

*Primary Examiner*—Hoang V. Nguyen
(74) *Attorney, Agent, or Firm*—Gifford, Krass, Groh, Sprinkle, Anderson & Citkowski, P.C.

(57) ABSTRACT

Passive or active pixelized antenna structures are described in which the radio-frequency (RF) tuning of individual antenna pixel elements, the connections of individual antenna pixel elements to other antenna elements, and optionally the local phase of individual elements or groups of elements, is varied and controlled using tunable elements. Efficient and low-cost control of a large number of tunable elements is provided by matrix addressing techniques.

30 Claims, 5 Drawing Sheets

ACTIVELY RECONFIGURABLE PIXELIZED ANTENNA SYSTEMS

REFERENCE TO RELATED APPLICATION

This application claims priority of U.S. Provisional Application Ser. No. 60/426,993, filed Nov. 14, 2002, the entire content of which is incorporated herein by reference.

FIELD OF THE INVENTION

The present invention relates to antennas, in particular to reconfigurable antenna arrays having tunable reactive elements.

BACKGROUND OF THE INVENTION

Pixelized, reconfigurable antennas are of interest for many applications. Phased array systems, for example, form one class of such antenna systems, but much simpler antennas are also of interest. Phased array systems are often active antennas, that is, they incorporate active elements such as electrically tunable elements. However, control of such active elements conventionally involves a high degree of complexity.

Pixelized antennas using interconnection switches rely on the availability of switches with appropriate characteristics. For low-cost, light-weight, and thin antennas, and particularly for antenna designs requiring many elements, this requires a large number of small and cheap RF switches. Although there has been some success in using microelectromechanical system (MEMS) approaches to fabricate small RF switches, the switches demonstrated thus far are expensive and often have relatively poor RF and/or reliability characteristics. Reconfigurable antenna systems are disclosed in U.S. Pat. Nos. 6,473,037 to Vail et al., 6,469,677 to Schaffner et al., 6,307,519 to Livingston et al., 6,198,438 to Herd et al., and 5,293,172 to Lamberty et al. However, there remains a need for improved reconfigurable antenna arrays and particularly a need for improvements in their switching mechanisms. These are the needs addressed by the present invention that provides efficient and low-cost control of a large number of tunable elements in such antenna array systems, as well as other applications.

All U.S. patents referred to in this specification are incorporated herein by reference in their entirety.

SUMMARY OF THE INVENTION

The present invention provides a passive or active pixelized antenna in which the RF tuning of individual antenna pixel elements, the connections of individual antenna pixel elements to other antenna elements, and optionally the local phase of individual elements or groups of elements, or any combination of these, is varied and controlled using electrically tunable elements, such as electrically tunable dielectrics.

An antenna includes a plurality of interconnected antenna pixels, each antenna pixel having one or more electrically tunable elements so as to vary and control one or more antenna pixel parameters, such as the radio-frequency (RF) tuning of the individual antenna pixel. A transistor, or other electronic switch, is provided for each of the tunable elements in each antenna pixel. Addressing of each transistor is through approaches analogous to those used in active matrix liquid crystal displays. Tunable elements include varactors, p-n junctions, MOS capacitors or FETs and tunable dielectrics including perovskite-structure materials, ceramics, barium strontium titanate, and organic materials. The antenna includes transmit and/or receive functions, and optionally provides gain in the direction of the transmit/receive connection. Antennas can be provided having a wide range of number of pixel elements including 100, 1000, or even more pixel elements, each with one or more tuned elements to control local phase, impedance, and interconnections with other antenna elements. Passive matrix addressing can also be used. Antennas can be used in connection with a cell phone or for an 802.11x wireless interconnect application.

The present invention provides efficient, flexible, and low-cost control for large numbers of antenna pixel tunable elements using approaches analogous to those used in liquid crystal displays.

DETAILED DESCRIPTION OF THE INVENTION

Figure 1:
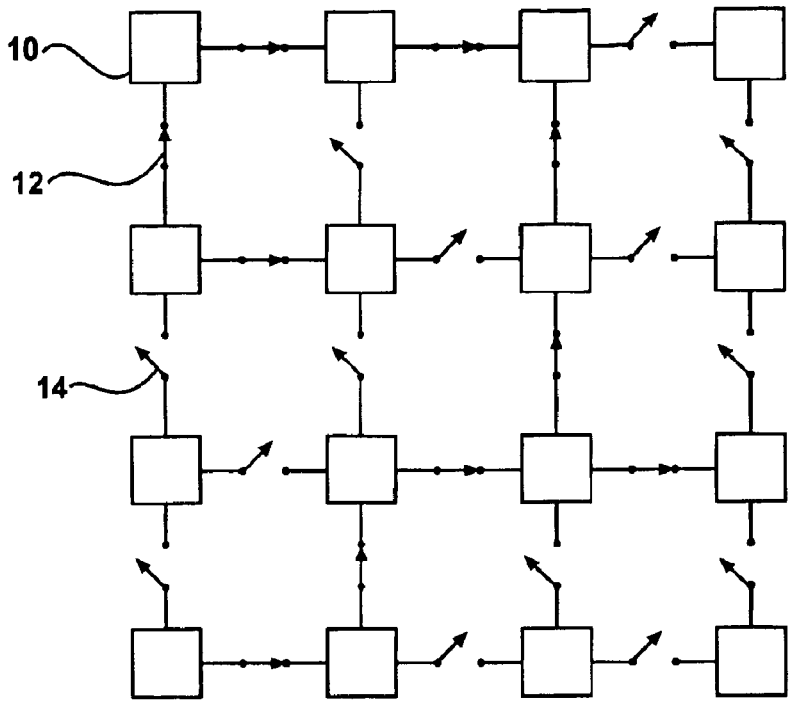
FIG. 1 shows a generalized pixelized antenna having interconnection switches.

FIG. 1 shows an antenna pixel 10, interconnected to other antenna pixels through interconnections such as 12, illustrated in the form of a closed switch. The electrical control of tunable elements, discussed in more detail below, allows pixel interconnections to be effectively removed, for example as shown in the form of an open switch at 14. The figure provides a schematic of a generalized reconfigurable antenna using switches to interconnect a (possibly large) number of antenna elements. Such an antenna can have a single or multiple RF feed-points (using single or multiple phases) and the antenna characteristics can be adjusted and controlled by varying the state of the switches that interconnect individual antenna elements.

Figure 2:
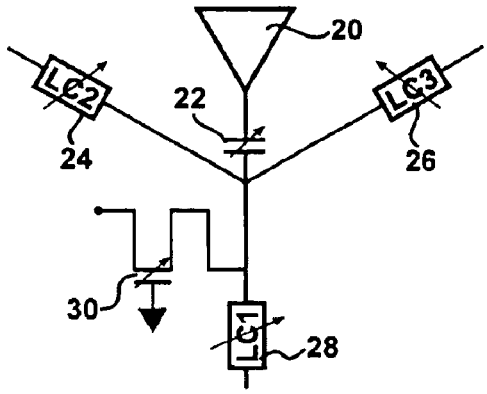
FIG. 2 shows an RF circuit configuration for a tunable antenna pixel, having tunable reactive elements that provide reconfigurability.

FIG. 2 shows an antenna pixel including radiative element 20, and five tunable elements, namely frequency control capacitor 22, first interconnection capacitor 24, second interconnection capacitor 26, third interconnection capacitor 28, and phase control capacitor 30. The five tunable elements are electrically tunable capacitors. The tunable elements allow independent control of antenna pixel parameters, such as radiated frequency, radiated phase, and the radiated phase of the antenna pixel relative to that of other interconnected pixels. The antenna pixel is illustrated from the standpoint of the RF characteristics of the pixel and its connections to other antenna elements.

Tunable elements (in this example, electrically tunable capacitors) are used to tune antenna pixel parameters, such as local frequency characteristics, local phase, and pixel interconnection with other elements. Three interconnections with other antenna pixels are shown; fewer (zero, one, or two) or more are also possible. For example, antenna pixels may be interconnected with adjacent antenna pixels within a row or block, and an interconnection parameter (for example, connected or isolated, relative phase, and the like) can be controlled by an electrical tuning signal.

Figure 3:
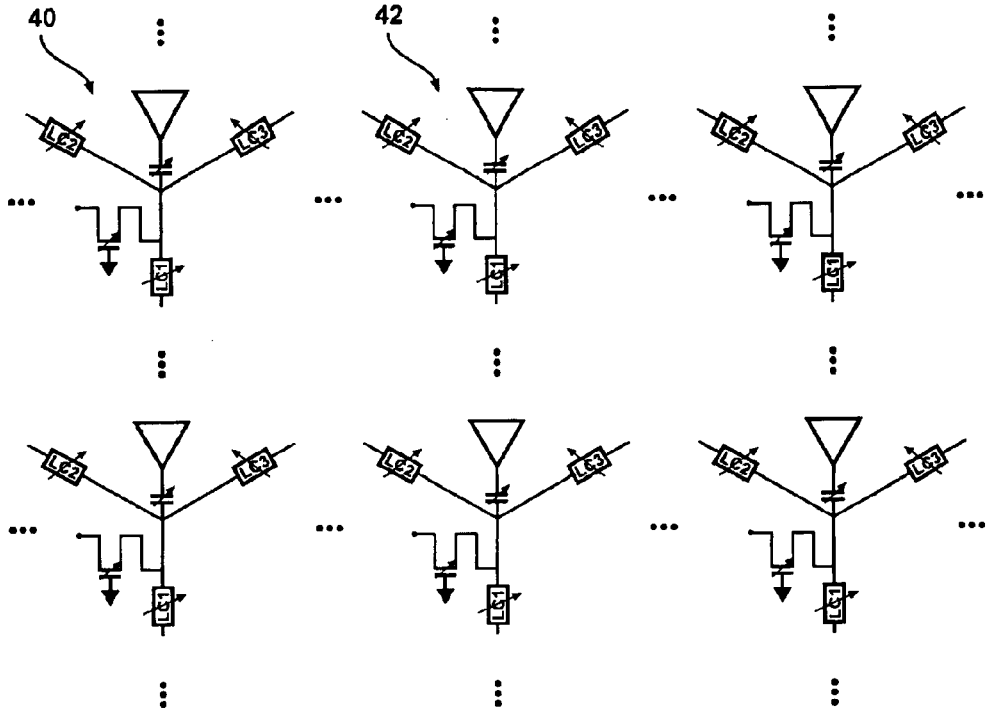
FIG. 3 shows a small section of a pixelized antenna array having tunable reactive elements.

FIG. 3 shows a portion of a pixelized antenna array, again from the standpoint of the RF characteristics of the antenna pixels and interconnections to other antenna pixels. The figure shows the antenna elements, such as antenna pixels 40 and 42, but does not explicitly show the connections between antenna pixels or the connections between antenna pixels and antenna feed-points.

Connections between antenna pixels can be made using single or multiple LC networks, constructed using either lumped or distributed elements, that provide connection or isolation depending on the tuning of the tunable capacitor. For some antenna designs, connections would be primarily or exclusively to adjacent or nearby elements but longer distance connections are also possible.

The number of elements that can be usefully series connected by LC (inductor-capacitor) networks depends on the reactive element Qs; series connections of three to ten or more elements are possible using currently available materials. A typical pixelized antenna might have hundreds, thousands, or even tens or hundreds of thousands of individual pixels, each with a number of tuned elements to control local phase and impedance and interconnections with other antenna elements. The invention provides efficient and low-cost control of the large number of tunable elements. Connecting wires directly between each tunable element and a control system is unwieldy for even a small number of elements and impractical for arrays with large numbers of pixels.

Figure 4:
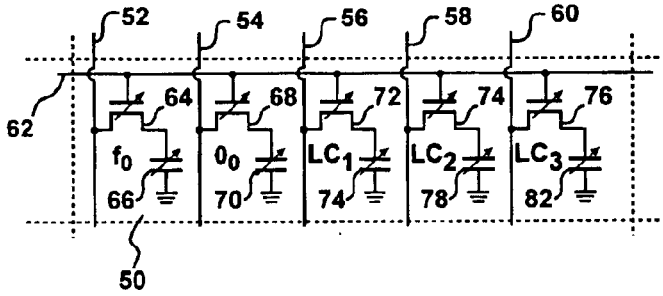
FIG. 4 shows a single tunable antenna pixel having five transistors used to control five voltage-variable (or tunable) capacitors.

FIG. 4 shows an electronic control circuit for a single antenna pixel 50, electrically connected to one row electrode 62 and five column electrodes 52, 54, 56, 58, and 60. The designations 'row' and 'column' are arbitrary. The antenna pixel includes five transistors 64, 68, 72, 76, and 80, and five electrically tunable elements 66, 70, 74, 76, 78, and 82. The gate of each transistor is electrically connected to the row electrode 62. When an appropriate electrical signal is applied to the row electrode 62, the five transistors are turned on, corresponding to the closing of an electronic switch, such that electrical signals applied to the five column electrodes are provided to the respective five electrically tunable elements.

In this context, turning a transistor "on" corresponds to decreasing the apparent resistance between first and second transistor terminals by applying an electrical signal to a third terminal (the gate of a field effect transistor). Removing the electrical signal from the third terminal substantially electrically isolates the other two terminals from each other. Other electronic switches may be used, for example a switch that is normally open or closed unless a selection signal is received. The dashed lines in FIG. 4 surround the control circuit components associated with a single antenna pixel.

In this example, transistor 64 functions as an electronic switch, having a first terminal connected to electrode 52, a second terminal connected to element 66, and a gate connected to electrode 62. When the gate receives a selection signal, the first and second terminals become in electrical communication. A tuning electrical signal applied to electrode 52 is then provided to element 66. When the selection signal is removed, the first and second terminals become electrically isolated. The electrical potential across element 66, due to an isolated electrical charge, will tend to remain unchanged until a new selection signal is received.

The annotations relative to the tunable elements correspond to those discussed above in relation to FIG. 2. For example, having selected a row including the pixel 50 by providing a row electric signal to the row electrode 62, the radiated frequency of the antenna pixel can be tuned by providing a frequency tuning electrical signal through column electrode 52.

Figure 5:
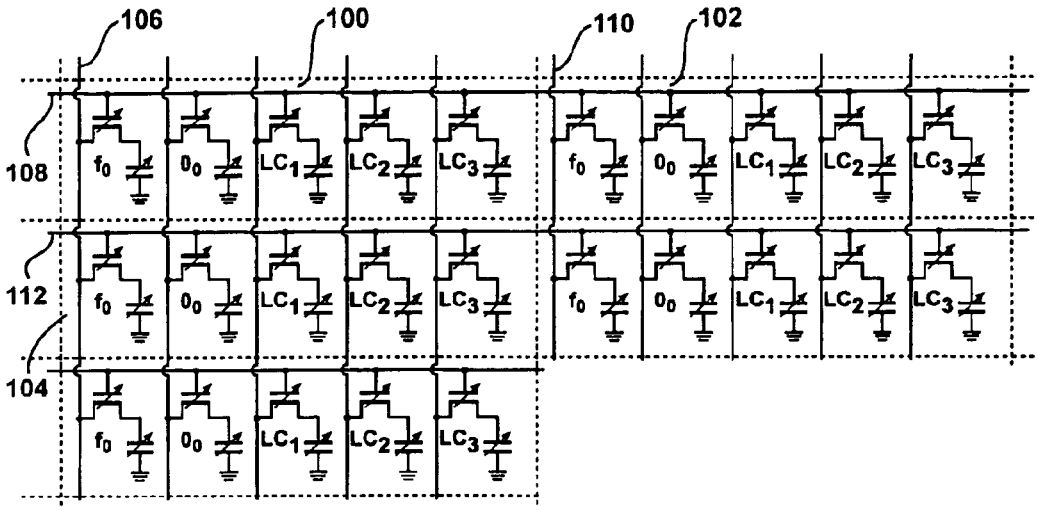
FIG. 5 shows a small section of pixelized antenna array using transistors to provide control voltages to tunable reactive elements.

FIG. 5 shows part of an electronic control circuit for a pixelized antenna. Pixels, such as 100 and 102, are each controlled through one row electrode and five column electrodes. In this example, selecting row electrode 108, for example by providing a voltage to the field effect transistor gates sufficient to turn on the transistors, selects pixels 100, 102, and other pixels similarly in electrical communication with this row electrode, collectively termed a selected row of pixels. The electrically tunable elements of each pixel within the selected row can then be controlled through electrical signals provided along the column electrodes, such as 106. Subsequently, a different row of antenna pixels can be selected, for example a row including pixel 104.

This figure shows a small section of the control circuitry for a pixelized antenna array having thin film transistor (TFT) control of the pixel tunable elements. For example, rows of antenna pixels would be selected and the required tuning data brought in on the corresponding column lines, in a manner similar to that used for display data in active matrix liquid crystal displays (AM-LCDs).

Figure 6:
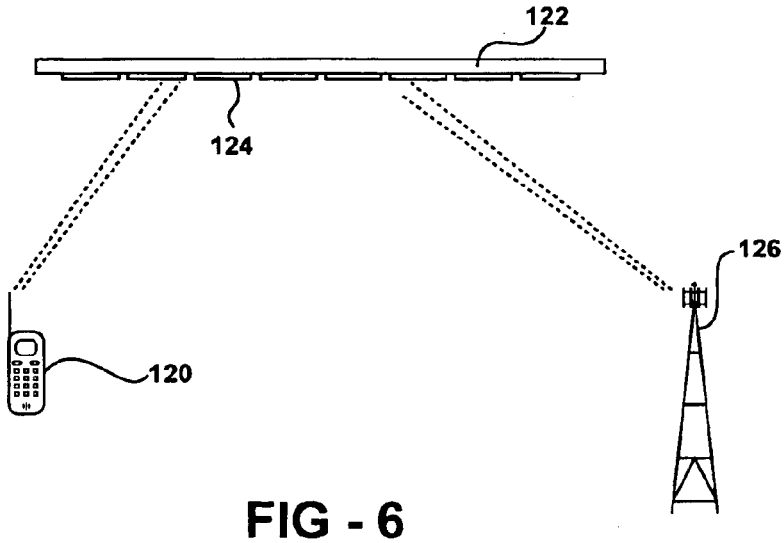
FIG. 6 shows a passive reflector, having no receiver or transmitter, actively reconfigurable using matrix addressing methods.

FIG. 6 shows a reconfigurable reflector 122, comprising reflector pixels 124, used to direct signals from a cell phone 120 to antenna 126. The reflection properties of the reflector can be controlled by the methods described elsewhere in this specification, such as matrix addressing methods.

Here, a reconfigurable antenna is used as an actively reconfigurable passive reflector, for example to allow cell phone communication within a building. The reflector is reconfigured to track single or multiple users within the building. Multiple reflectors can be used in combination to provide communications to deep interior locations. A similar system could be used, for example, for RF-based personnel monitoring in otherwise inaccessible locations such as ships or buildings.

Figure 7:
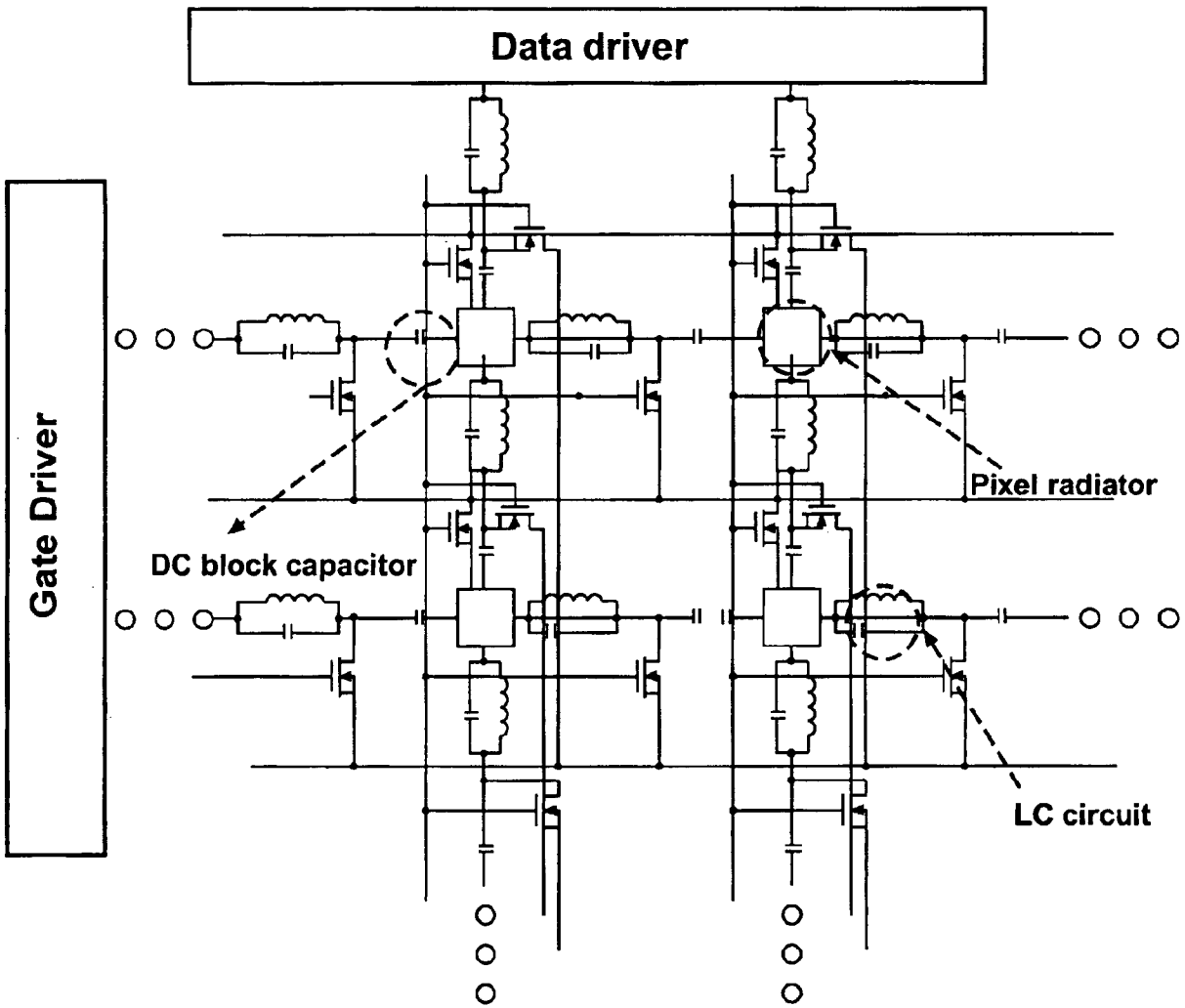
FIG. 7 shows how a small antenna section is realized using thin film transistors, varactors, inductors, and fixed value (non-tunable) capacitors.
Figure 8:
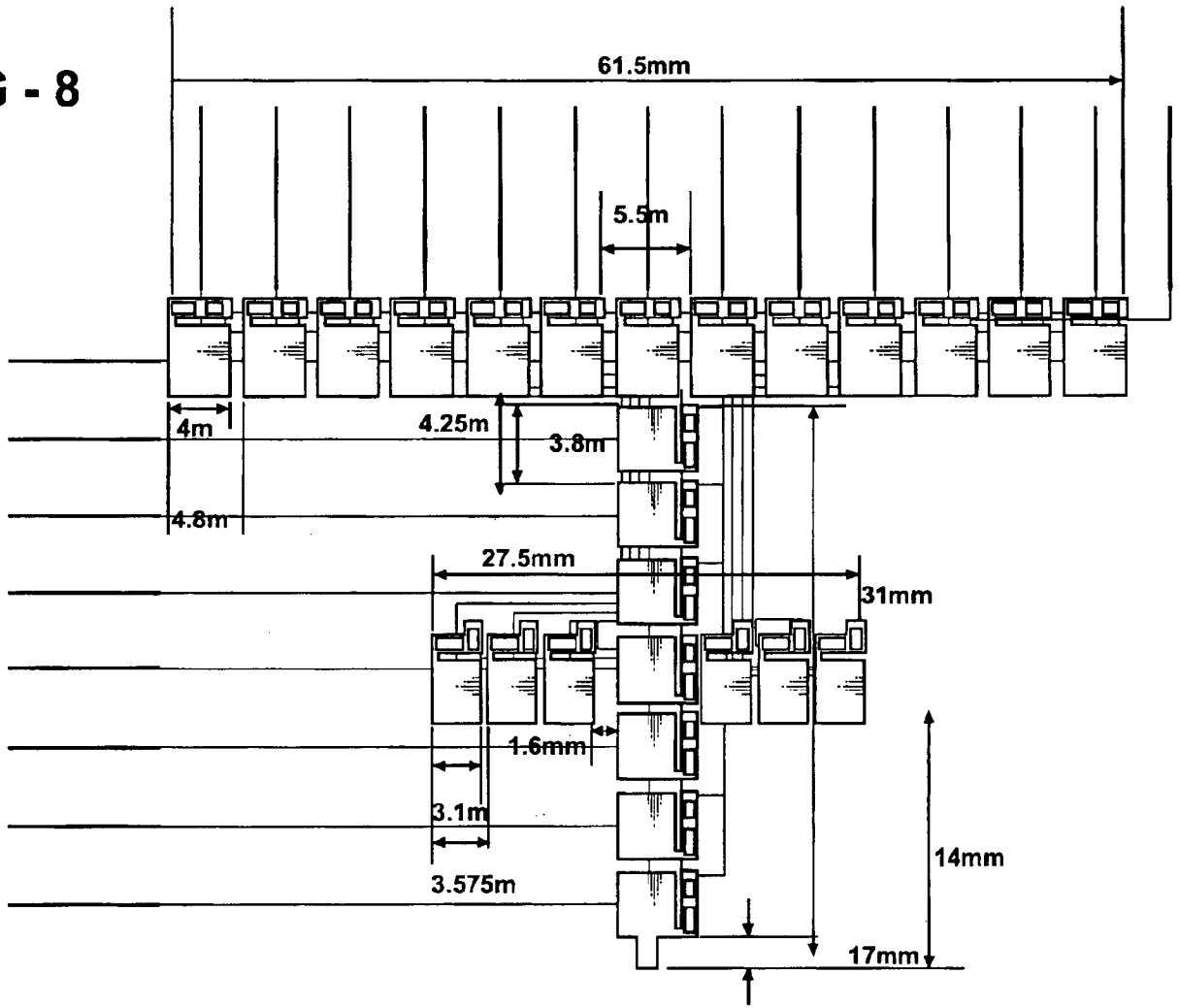
FIG. 8 shows the physical layout for a simple tunable antenna the inventor is building.

FIG. 7 shows how a small antenna section is realized using thin film transistors, varactors, inductors, and fixed value (non-tunable) capacitors. FIG. 8 shows the physical layout for a simple tunable antenna the inventor is building

Matrix Addressing

Electronic control of a single antenna pixel is possible using a matrix addressing method. In the examples discussed above in relation to FIGS. 4 and 5, five transistors per antenna pixel are used to control five electrically tunable elements, one transistor being used for each of the tunable elements in each antenna pixel. Configurations with fewer or greater numbers of tunable elements and corresponding transistors are also possible.

Matrix addressing of antennas provides an efficient method for control of antenna pixel parameters (such as radiative frequency and phase) and antenna characteristics such as the spatial distribution of radiated energy and/or receiver sensitivity (antenna direction and beam-shape).

In one illustrative example, an antenna comprises a number of antenna pixels, each having a radiative element and at least one electrically tunable element. The antenna pixels are arranged in an array, for example a rectangular array having rows and columns. Each pixel has at least one electronic switch, in this example a field effect transistor. Row electrodes are connected to the gates of pixel transistors, and electronic circuitry (for example, a first integrated circuit) is provided to select rows one at a time, sequentially. In this context, row selection corresponds to providing a selection signal (an electrical signal such as the gate voltage required to turn on the field effect transistors) to a row electrode in electrical communication with the gates of transistors within a row of pixels, so that electrical signals provided by column electrodes are transmitted through the respective transistors to the electrically tunable elements.

The electronic circuitry provides an electronic signal to the gates of the transistors within one row of antenna pixels. The transistors in the selected row are turned on and electronic circuitry (for example, a second integrated circuit) is used to provide signals through column electrodes to adjust the antenna pixel parameters within the selected row.

The approach is analogous to that used to drive active matrix liquid crystal displays (AM-LCDs), allowing the use of low-cost off-the-shelf integrated circuits (ICs) to provide row and column signals, with single row (or column) update times typically near 10 microseconds. In a typical liquid crystal display, pixels are arranged into rows and columns, and the N rows and M columns are used to control the N×M pixels. In active matrix liquid crystal displays (AM-LCDs), for example, transistors (typically hydrogenated amorphous silicon thin film transistors), are used to control the brightness of each display pixel (typically of each red, blue, and green sub-pixel for full-color displays). Overall, a typical SVGA or XGA display uses millions of transistors to control the characteristics of millions of pixels or sub-pixels and does so simply, efficiently, and with low power and low cost.

Antenna pixels can be provided with several tunable elements, each having one or more control transistor. Even for a large antenna, the total number of transistors need not exceed the number routinely controlled in low-cost, commercial active matrix displays. For example, a 5×10 meter antenna with 1×1 cm antenna pixels each with five tunable elements could be controlled with 1000 gate select rows and 2500 data columns (controlling a total of $2.5\times10^6$ transistors and associated tunable elements). For comparison, a typical SXGA laptop AM-LCD display may have 1050 gate select rows and 4200 data columns (controlling a total of $4.41\times10^6$ transistors and color sub-pixels).

In addition, because a typical small antenna pixel (for example, one having millimeter dimensions) is larger than typical liquid crystal display pixel size, the cost per area to fabricate the control TFTs for a pixelized antenna will be less than that for displays. For example, antennas can be formed by low-cost lithographic approaches such as printing.

In one illustrative example, an antenna includes a substrate having electronic control circuitry (for example, a grid of electrodes and thin film transistors) supported on one side of the substrate, and RF circuitry supported on the other side of the substrate. Matrix addressing control circuitry provides electronic control of electronically tunable elements of the RF circuitry, for example through tunable capacitors having dielectric tuning electrode leads extending through the substrate.

In another example, an antenna includes a plurality of antenna pixels in a rectangular array, each antenna pixel having a single electrically tunable element. The RF components of the antenna array are supported by a substrate. The substrate also supports a first plurality of electrodes (column electrodes) and a second plurality of electrodes (row electrodes), which form part of an electronic control circuit for the antenna. (The designations of row and column are arbitrary). The row and column electrodes are orthogonal, so as to provide a grid pattern, and row and column electrodes are not in electrical communication except through control circuit components. Each column electrode is electrically connected to one terminal of electronic switches associated with a column of antenna pixels. A second terminal of each electronic switch is connected to an electrically tunable element, and tuning electrical signals applied along the column electrode are passed to the electrically tunable element if a selection signal is received by the electronic switch from a row electrode. Each row electrode is in electrical communication with electronic switches associated with one row of antenna pixels. A selection signal is applied to a row electrode so as to select the row of antenna pixels. The tuning electrical signal can have an analog variation, or may be provided at one of a number of predetermined levels, such as 256 levels, for example using circuitry analogous to that used to provide gray levels to an AM-LCD.

Rows of antenna pixels can be selected sequentially one at a time, and tuning electronic signals provided through the column electrodes to antenna pixels within the selected row. In some applications, a plurality of rows may be selected simultaneously, for example to provide symmetrical or other spatial relationships between antenna pixel parameters. The tuning electrical signal may pass through additional conditioning electronics after the electronic switch before reaching the electrically tunable element, such as filters, signal averaging circuits, voltage adders or dividers, gain circuitry, or other circuitry.

Electrodes may include electrically conducting oxides, metal films, metal wires, superconducting films, conducting polymers, or other electrically conducting materials.

Rows and columns of electrodes can provide a grid pattern of electrodes, and a tunable element can be conveniently located proximate to the crossing point of a row electrode and a column electrode. The grid pattern can be orthogonal, or rows and columns provided at some other angle to each other. The row electrodes and column electrodes are electrically isolated from each other at their crossing points. In other embodiments, other pixel geometries can be addressed using analogous methods. For example, one set of electrodes can be used to select an angular coordinate, and another set of electrodes used to provide tuning electrical signals over a range of a spatial coordinate. For example, one set of electrodes can be used to select pixels in along a radial direction, and another set of electrode used to apply tuning signals to pixels at different locations along the radial direction.

Matrix addressing techniques used in passively addressed liquid crystal displays can also be applied to pixelized antennas. In this case, electronic switches such as transistors are not provided at each antenna pixel. Typically, row selection signals are in the form of pulses, and data signals provided over column lines can be fairly complex. However, such matrix addressing techniques are well known in the field of supertwisted nematic liquid crystal displays (STN-LCDs). In some applications, the fluctuating voltages applied across a voltage tunable capacitor may be problematic. However, for example, the voltage applied to an electrically tunable element can be averaged over a frame time, or longer period, by conventional electronic methods, such as RC networks, allowing passive addressing techniques to be successfully applied to pixelized antennas.

Examples discussed above associate a thin film transistor (TFT) of the type used in active matrix liquid crystal displays with each tunable element of an antenna pixel. However, electronic switches other than TFTs can be used, such as other field effect transistors, bipolar transistors, other discrete components, other thin film devices, integrated circuits, logic gates, other semiconductor devices or circuits, relays (for example including relays having a coil energized by a row electric signal), or other switch.

Tunable Elements

One or more tunable elements or combination of tunable elements can be used within an antenna pixel, such as a capacitor, inductor, combination of capacitor and inductor, combination of resistor and capacitor, and the like. Tunable capacitors include varactors and other p-n junctions devices, MOS capacitors and MOSFETs, MEMS (microelectromechanical systems), and capacitors having tunable dielectrics. Tunable dielectrics provide wide tunability, compatibility with thin film electronics technology, and potentially very low cost. Currently available tunable dielectrics, for example barium strontium titanate (BST), can provide greater than 80% dielectric constant tunability with loss characteristics useful for applications up to about 10 or 20 GHz. Other ferroelectric materials also promise similar tunability with low-loss characteristics for frequencies approaching the THz range and with improved temperature stability compared to BST.

Electrically tunable dielectrics can include a ferroelectric material, titanate (such as barium titanate, barium strontium titanate, strontium titanate, lead titanate, lead strontium titanate, or other titanate), zirconate (such as lead zirconate), niobate (such as potassium niobate), tantalate (such as potassium tantalate), other oxide (such as silicon oxide), ceramic (such as perovskite structure ceramic), organic material, and the like. Certain tunable dielectrics fall under more than one category within the above list, for example many titanates have a ferroelectric phase. Electrically tunable dielectrics suitable for use in tunable elements are described in U.S. Pat. Nos. 5,589,845 and 5,721,194 to Yandrofski et al., 5,557,286 to Varadan et al., 5,990,766 to Zhang et al., 6,096,127 to Dimos et al., and 6,211,096 to Allman et al.

Ferroelectric materials can be used above their Curie temperature, in a paraelectric or other non-ferroelectric phase. In this specification, the term ferroelectric material refers to a material having a ferroelectric phase, but which is not necessarily ferroelectric under the conditions of antenna operation.

Electrically tunable capacitors having an electrically tunable dielectric layer can be provided with one or more electrodes for applying an electric field to the dielectric, which can be separate from the electrodes of the voltage tunable capacitor.

Other tunable elements include varactors and other p-n junctions devices, MOS capacitors and MOSFETs, ferrites, PIN diodes, micromechanical devices, movable electrode capacitors (for example, as described in U.S. Pat. No. 5,519,565 to Kalt et al.), and the like.

For example, a tuning electrical signal can be used to set the capacitance of an electrically tunable capacitor to a predetermined value, to heat a tunable element (for example, through resistive heating), to provide a magnetic field (for example, through a coil), to radiate a tunable element through light or other radiation emission, or to adjust the band structure of an electronic device such as a quantum well. The controlled property of a tunable element can include capacitance, inductance, resistance, Q-factor, resonant frequency, permeability, polarization, transmittance, reflectance, or other physical property.

RF Circuitry

Radiative elements within an antenna pixel can include, for example a loop, patch, or other radiative structure, as are well known in the art. The radiative element and one or more ferroelectric element can be combined into an integrated module. Examples of antenna patches which may be used in the present invention are disclosed in U.S. Pat. Nos. 5,472,935 to Yandrofski et al., 5,617,103 to Koscica et al., 6,292,143 to Romanofsky, and 6,496,147 to Kirino.

Individual antenna pixel elements can be fed from a fixed antenna feed-point or multiple feed-points. For multiple feed-points the feed-point phase can be the same or varied for different feed-points. In either case the local phase of the individual antenna pixel element can be varied relative to the feed-point and to other elements by the tunable phase element (for example a microstrip line including a tunable dielectric). In other examples, each antenna pixel can be provided with a separate radio-frequency (RF) feed, or, optionally, separate RF signals can be provided to individual rows and/or columns of antenna pixels, or to other groupings of antenna pixels.

Antenna pixels are interconnected by any appropriate structures, for example transmission lines, such as microstrip lines, resistor-capacitive (RC) networks, and the like. As discussed above, the interconnections can include tunable elements which are matrix addressed. The resonant frequency of an RC network can be tuned or switched so as to substantially isolate or substantially connect two antenna pixels. The relative RF phase difference of two antenna pixels can also be adjusted. The connection status between antenna pixels can be controlled by tunable elements, for example electrically tunable capacitors. The connection status can be electrically connected, for example allowing an RF signal to pass from one antenna pixel to another, electrically isolated, and may also include a variable phase of one pixel relative to another.

Other Embodiments

The antenna technology described in this specification has an important impact for a wide range of applications. As a simple example, consider an antenna for a cell phone, or for an 802.11b wireless interconnect application. Antenna function for such applications would be substantially improved if the antennas provided gain in the direction of the transmit/receive connection. However, this direction is not known a priori so omnidirectional antenna patterns are typically chosen in preference to those with directional gain. However, a reconfigurable antenna could be used to provide an omnidirectional pattern to establish an initial wireless connection and the connection could then be optimized by using a simple search algorithm to optimize the antenna gain in the required direction. Many alternatives are possible. For example, antenna reconfiguration could be used with a sector search approach to provide gain in selected direction in a search pattern to establish the initial wireless connection and the connection could then be further optimized by additional antenna reconfiguration.

As another example, a reconfigurable antenna could be used to track and provide optimal connection between a moving vehicle, and, for example, a satellite system. The antenna configuration could easily be optimized on a time scale adequate to compensate for a yawing and pitching land or sea vehicle. In the two examples above the reconfigurable antenna would be connected to an active transmit or receive system, though a reconfigurable antenna can also be used as an actively reconfigurable passive reflector as discussed above.

While the invention has been particularly shown and described with reference to preferred embodiments thereof, it will be understood by those skilled in the art that various alterations in form and detail may be made therein without departing from the spirit and scope of the invention. In particular, the number of pixels, addressable elements and the antenna applications can vary widely within the scope of the invention.

Having described my invention, I claim:

1. An antenna, comprising:

a first plurality of electrodes;

a second plurality of electrodes; and a plurality of antenna pixels, each antenna pixel including an electrically tunable element and a control circuit, the control circuit being in electrical communication with a first electrode, a second electrode, and the tunable element, the first electrode being one of the first plurality of electrodes, the second electrode being one of the second plurality of electrodes, such that a tunable property of the tunable element is set to a predetermined value by a tuning electrical signal provided by the first electrode when a selection signal is provided to the control circuit by the second electrode.

2. The antenna of claim 1, wherein the plurality of antenna pixels is arranged in a pixel array, the pixel array having a plurality of pixel rows and a plurality of pixel columns, each of the first plurality of electrodes being in electrical communication with antenna pixels within a pixel column, and each of the second plurality of electrodes being in electrical communication with antenna pixels within a pixel row.

3. The antenna of claim 1, wherein the first plurality of electrodes and the second plurality of electrodes form a grid pattern of electrodes.

4. The antenna of claim 1, wherein the tunable property of the electrically tunable element is an electrical capacitance.

5. The antenna of claim 4, wherein the tunable element comprises a voltage tunable dielectric material.

6. The antenna of claim 1, wherein the control circuit includes an electronic switch, the electronic switch transmitting the tuning electric signal from the first electrode to the tunable element when the electronic switch receives the selection signal.

7. The antenna of claim 6, wherein the electronic switch is a transistor.

8. The antenna of claim 6, wherein the electronic switch is a field effect transistor having a gate in electrical communication with the second electrode, the selection signal being a gate voltage sufficient to turn on the field effect transistor.

9. The antenna of claim 1, wherein each antenna pixel includes a radiative element, the radiative frequency of the radiative element being correlated with the tunable property of the tunable element.

10. The antenna of claim 1, wherein each antenna pixel includes a radiative element, the radiative phase of the radiative element being correlated with the tunable property of the tunable element.

11. An antenna, comprising:

a first plurality of electrodes;

a second plurality of electrodes; and a plurality of antenna pixels, each antenna pixel having an electrically tunable element, and a control circuit in electrical communication with a first electrode from the first plurality of electrodes and with a second electrode from the second plurality of electrodes, the control circuit being operable to set an electrical property of the electrically tunable element to a value determined by a tuning electrical signal provided by the first electrode when a selection signal is provided by the second electrode.

12. The antenna of claim 11, wherein each electrode from the first plurality of electrodes is connected to a plurality of control circuits within a group of antenna pixels, antenna pixels within the group each being connected to a different electrode from the second plurality of electrodes.

13. The antenna of claim 11, wherein providing a selection signal to a selected electrode from the second plurality of electrodes selects a selected group of antenna pixels, the selected group of antenna pixels including antenna pixels in electrical communication with each of the first plurality of electrodes.

14. The antenna of claim 11, wherein the plurality of antenna pixels are arranged within a pixel array, each of the first plurality of electrodes being connected to a row of antenna pixels within the pixel array, each of the second plurality of electrodes being connected to a column of antenna pixels within the pixel array.

15. The antenna of claim 11, wherein the electrical property is an electrical capacitance, the electrical capacitance being used to control a parameter of the antenna pixel, the parameter being chosen from a group consisting of radiative frequency of the antenna pixel, radiative phase of the antenna pixel, reflectivity of the antenna pixel, and connection status between the antenna pixel and another antenna pixel.

16. The antenna of claim 11, further comprising matrix addressing circuitry operable to control an antenna parameter, the antenna parameter being chosen from a group consisting of antenna radiative direction, antenna reception direction, and antenna reflection direction.

17. An antenna comprising a plurality of antenna pixels, each antenna pixel having:

an electrically tunable element;

a radiative element; and an electronic switch providing electrical communication between a first switch terminal and a second switch terminal when a selection signal is received by the electronic switch, the first switch terminal being electrically connected to a first electrode, the second switch terminal being electrically connected to the electrically tunable element, the selection signal being provided by a second electrode, such that the electrically tunable element is electrically controlled by a tuning electrical signal provided through the first electrode when the selection signal is provided to the electronic switch through the second electrode.

18. The antenna of claim 17, wherein the first electrode in electrical communication with a first plurality of antenna pixels, the second electrode is electrical communication with a second plurality of antenna pixels, there being only one antenna pixel in common between the first and second pluralities of antenna pixels.

19. The antenna of claim 17, wherein the antenna pixels are arranged within an array of antenna pixels, the antenna further comprising a plurality of row electrodes, each row electrode being in electrical communication with antenna pixels within one row of antenna pixels, and a plurality of column electrodes, each column electrode being in electrical communication with antenna pixels within one column of antenna pixels, the first electrode being a column electrode and the second electrode being a row electrode.

20. The antenna of claim 19, further comprising a row selection electronic circuit operable to provide selection signals to a selected row electrode, so as to provide a selected row of antenna pixels; and a column addressing electronic circuit operable to provide tuning electrical signals through the column electrodes to electrically tunable elements of antenna pixels within the selected row of antenna pixels.

21. The antenna of claim 17, wherein the electrically tunable element is a voltage tunable capacitor.

22. The antenna of claim 21, wherein the voltage tunable capacitor includes a voltage tunable dielectric material.

23. The antenna of claim 22, wherein the voltage tunable dielectric material includes a ferroelectric material.

24. The antenna of claim 22, wherein the voltage tunable dielectric material includes an oxide.

25. The antenna of claim 22, wherein the voltage tunable dielectric material includes a titanate.

26. The antenna of claim 17, wherein the electrically tunable element is used to modify at least one antenna pixel parameter, the antenna pixel parameter being chosen from a group of antenna pixel parameters consisting of: radiated frequency, radiated phase relative to a radio-frequency input, radiated phase relative to another antenna pixel, and connection status relative to another antenna pixel.

27. The antenna of claim 17, wherein the electronic switch is a transistor, and the selection signal is provided to a base or gate of the transistor.

28. The antenna of claim 17, wherein the plurality of antenna pixels is arranged in a pixel array having rows and columns, each antenna pixel being part of one row and one column.

29. The antenna of claim 21, wherein the voltage tunable capacitor is a P-N or P-I-N junction devices.

30. The antenna of claim 21, wherein the voltage tunable capacitor is an MOS capacitor or MOSFET.

* * * * *